US006889848B2

(12) United States Patent
Allison

(10) Patent No.: US 6,889,848 B2
(45) Date of Patent: May 10, 2005

(54) COIN SORTING AND DISPENSING APPARATUS FOR MOTOR VEHICLES

(75) Inventor: John Hugh Allison, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 231 days.

(21) Appl. No.: 09/998,072

(22) Filed: Nov. 29, 2001

(65) Prior Publication Data

US 2003/0100255 A1 May 29, 2003

(51) Int. Cl.[7] ..... B07C 5/00
(52) U.S. Cl. ..... 209/534; 235/33; 453/3
(58) Field of Search ..... 453/3, 4, 5, 6, 453/7, 8, 9, 10, 11, 12, 13, 14, 15, 58, 57; 209/534; 232/7, 8, 9, 10, 11, 12, 13, 14; 235/33

(56) References Cited

U.S. PATENT DOCUMENTS

| | | | | |
|---|---|---|---|---|
| 1,260,802 A | | 3/1918 | Purt | |
| 2,487,163 A | | 11/1949 | Miconi | |
| 2,764,990 A | | 10/1956 | Pick | |
| 2,790,450 A | | 4/1957 | Goldy | |
| 3,135,270 A | | 6/1964 | Arnold | |
| 4,928,970 A | | 5/1990 | Latimer, Jr. | |
| 5,106,337 A | * | 4/1992 | Knox | 453/9 |
| 5,112,276 A | | 5/1992 | Spaeth | |
| 5,449,105 A | | 9/1995 | Schiff et al. | |
| 5,855,308 A | | 1/1999 | Ziegler et al. | |
| 5,902,178 A | | 5/1999 | Perkitny | |
| 6,165,063 A | * | 12/2000 | Perkitny | 453/9 |
| 2001/0021633 A1 | * | 9/2001 | Orton et al. | 453/3 |

* cited by examiner

*Primary Examiner*—Donald P. Walsh
*Assistant Examiner*—Kenneth W Bower
(74) *Attorney, Agent, or Firm*—Brinks Hofer Gilson & Lione

(57) ABSTRACT

A combined coin sorting and dispensing apparatus for motor vehicles which may be mounted in or integrally formed with the dashboard, console, or an existing interior door or side panel, or placed in an existing pocket of the vehicle. The coin sorter has a hopper with a coin slot, a coin sorter plate, a coin holder support, and a plurality of coin holders. In operation, coins placed in the hopper pass through the coin slot, and fall onto an inclined sorter plate which sorts the coins into the coin holders. The motion of the motor vehicle as it is being driven assists in moving the coins through the hopper, down the coin slot, and down the sorter plate. The sorted coins are stored in the coin holders until needed at which time they are manually or automatically dispensed from the holders. Methods for sorting the coins using the disclosed combined coin sorting and dispensing apparatus are also disclosed.

22 Claims, 5 Drawing Sheets

Fig. 4
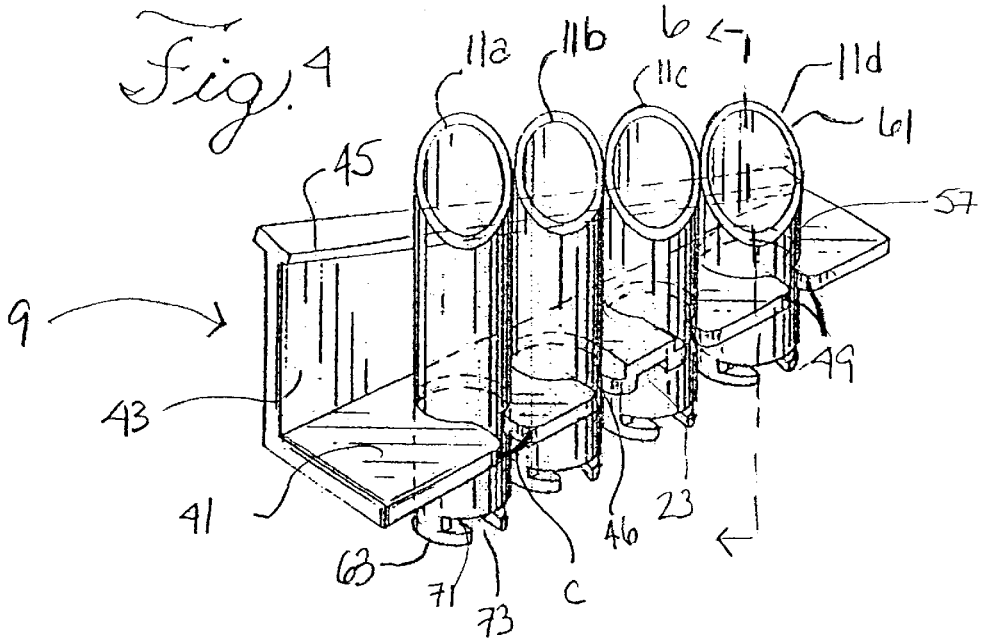
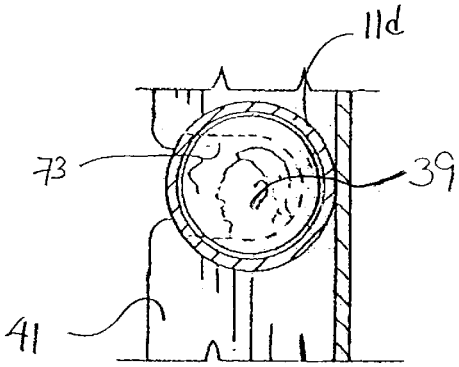
Fig. 5
Fig. 6
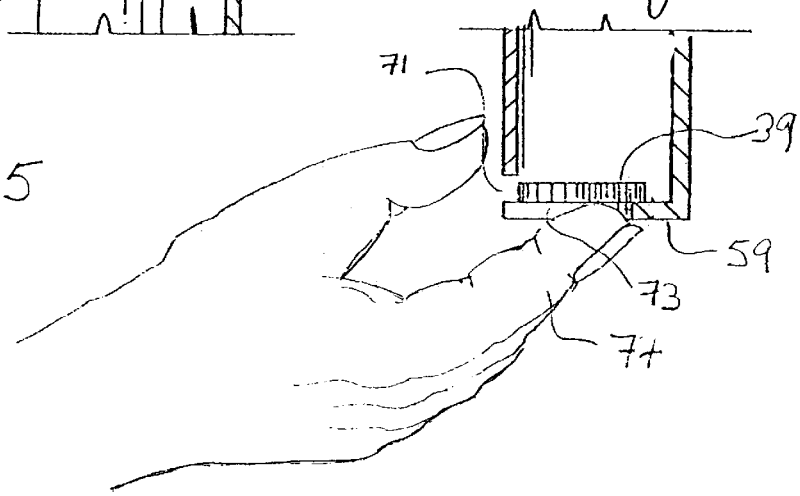

COIN SORTING AND DISPENSING APPARATUS FOR MOTOR VEHICLES

FIELD OF THE INVENTION

This invention relates to a combined coin sorter and dispenser. In particular, this invention relates to a combined coin sorting and dispensing apparatus, which is mounted in a motor vehicle wherein the motion of the vehicle assists in sorting the coins. This invention further relates to methods of sorting coins using the disclosed coin sorting and dispensing apparatus.

BACKGROUND

It is often necessary to have spare change in a vehicle in order to pay for tolls, parking meters, or roadside newspapers. However, it is quite difficult to look for and find change in a purse, wallet, or a pants pocket while driving alone and indeed can be quite hazardous when driving at higher speeds or when approaching a crowded tollbooth area. In order to avoid having to look through a purse or in a pocket, some drivers place spare change in an ashtray, a drink holder, or other compartment in the vehicle. While the driver may be able to access the change in these compartments more readily, the driver must still take his or her eyes off the road to find the compartment and then sort through the coins for the exact amount of change needed. Moreover, if ashtrays, drink holders, or other compartments are used as spare change holders, the driver and other passengers in the car do not have the use of these amenities while traveling.

In an effort to eliminate to such problems, various types of coin holders for vehicles have been developed. Such coin holders are generally built into the dashboard, into the console between the driver and passenger seats, or mounted on the dashboard or sun visor of the vehicle. Representative examples of such coin holders are disclosed in U.S. Pat. Nos. 5,855,308, 5,449,105, and 5,112,276. None of these coin holders, however, are capable of sorting coins.

Therefore, it is believed that there is a need in the motor vehicle industry for a combined coin sorting and dispensing apparatus that may be mounted in or integrally formed with the dashboard, console, or an existing interior door or side panel, or placed in an existing pocket of the vehicle. It is further believed that there is demand for a combined coin sorting and dispensing apparatus for a motor vehicle which is compact, easily assembled, and inexpensive to manufacture, but which efficiency and effectively sorts, stores, and dispenses coins.

BRIEF SUMMARY OF THE INVENTION

The coin sorting and dispending apparatus of the present invention includes a housing formed from a front wall, a back wall and two end walls. A hopper for receiving coins is positioned in the upper portion of the housing. The hopper includes an opening, which is sized to allow coins to pass therethrough and fall onto a sorter plate positioned below the hopper. The sorter plate is longitudinally downwardly inclined and includes at least one slot. A coin support holder with at least one coin holder is positioned below the sorter plate in the lower end of the housing.

In another aspect of this invention, a method of sorting, storing, and dispensing coins is provided. Coins are placed in the hopper and pass one at a time through the opening in the hopper and onto the sorter plate. Each coin slides down the plate until it falls through a slot and into a coin holder positioned below the slot. Coins are stored in the coin holders and are removed through a slot in the coin holder when needed. The motion of the vehicle as it is driven assists the flow of the coins through the sorting apparatus.

The present invention provides significant advantages over the prior art coin holders for motor vehicles.

Further features and advantages of the present invention will be apparent upon reviewing the following detailed description and accompanying drawings.

BRIEF DESCRIPTION OF SEVERAL VIEWS OF THE DRAWINGS

FIG. 4 is a perspective view of one embodiment of a coin holder support with coin holders used in the coin sorting and dispensing apparatus of the present invention;

FIG. 5 is a representative top view of one of the coin holders shown in FIG. 4;

FIG. 6 is a partial cross-sectional view of the coin holder 11*d* shown in FIG. 4 taken along line 6—6 illustrating one embodiment of a coin dispensing mechanism;

DETAILED DESCRIPTION OF THE PREFERRED EMBODIMENTS

Figure 1:
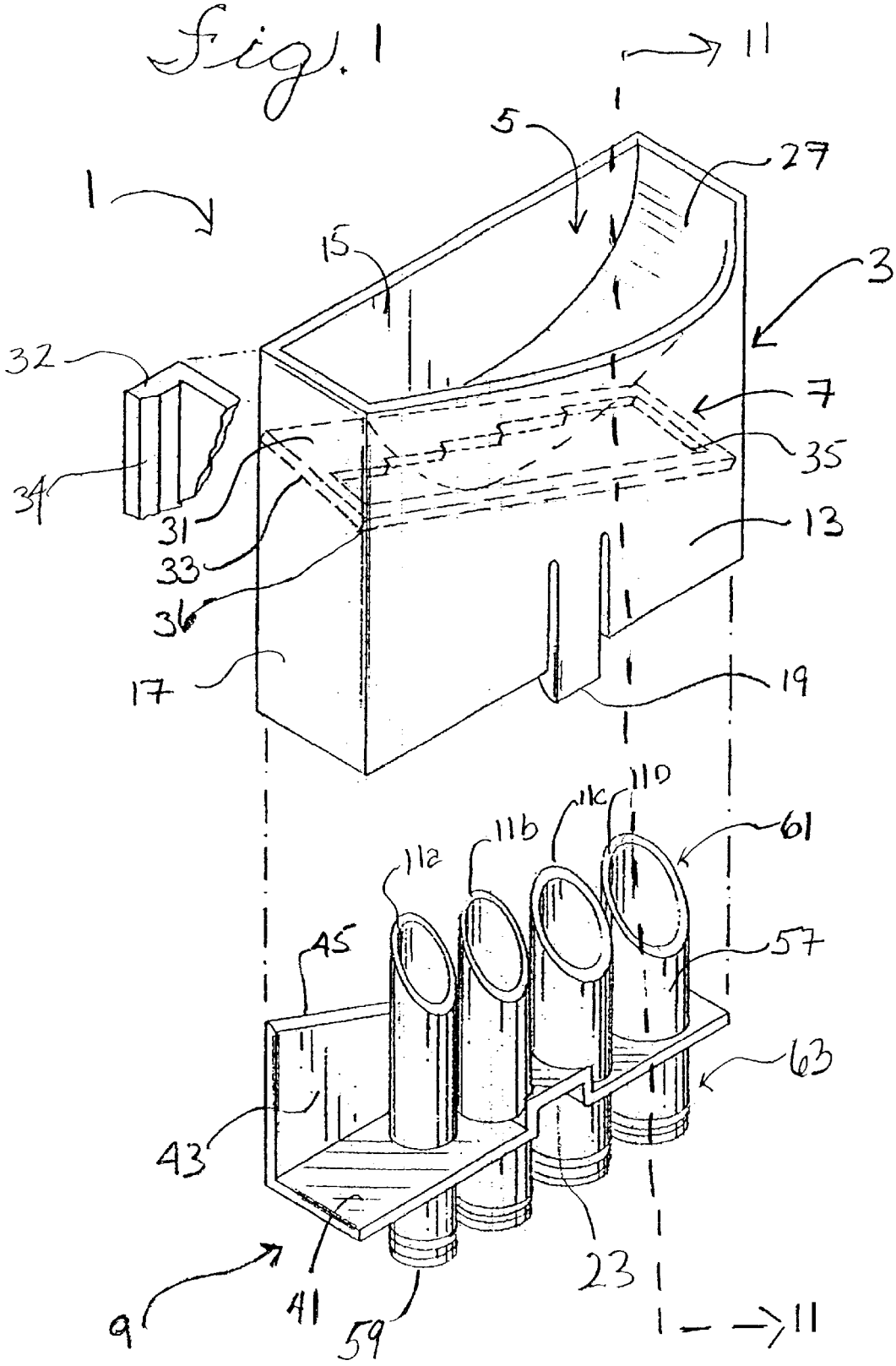
FIG. 1 is a partially exploded perspective view of one embodiment of the coin sorting and dispensing apparatus of the present invention.

Referring now to the Figures, FIG. 1 illustrates a partially exploded view of one embodiment of the coin sorting and dispensing apparatus 1 of the present invention. The apparatus 1 generally has a housing 3, a coin hopper 5, a sorter plate 7, a coin holder support 9, and a set of coin holders 11*a–d* for storing and dispensing coins. As shown in FIG. 1, the housing 3 is generally rectangular in shape and has a front wall 13, a back wall 15, opposite the front wall 13, a first side wall 17, and a second side wall, not shown, opposite the first side wall 17. The housing back wall 15 may be formed integrally with the first and second side walls. Alternatively, the back wall 15 may be a portion of the interior of the vehicle, such as a door panel or the dashboard, to which the coin sorting and dispensing apparatus is affixed.

The housing 3 may be affixed to the interior of the vehicle by any attachment devices well-known in the art of vehicle manufacturing, including but not limited to hooks, prongs, screws, nails, hook and loop fasteners, suction cups, and adhesive. In one embodiment, the housing is affixed to the interior of the vehicle by two flanges 32 extending from the first side wall 17 and the second side wall, not shown, of the housing. The flanges 32 may be integrally molded as part of the side walls or may be separately molded on the side walls. Corresponding "T" shaped slots, not shown, for receiving the flanges 32, are positioned on an interior portion of the vehicle, such as a panel, where the housing will be affixed. The flanges 32 are slidably mounted into the corresponding "T" shaped slots to affix the housing to the interior of the vehicle. In one embodiment, the edges 34 of the flanges 32 are beveled in order to make it easier to slide flanges 32 into the corresponding "T" shaped slots. Alternatively, housing 3 may be integrally formed as part of a door panel, the dashboard, or console of the vehicle.

A tab 19 extends slightly below a bottom 21 of the front wall 13. The tab 19 engages a notch 23 on the coin holder support 9 so that housing 3 and coin holder support 9 can be snapped together. The coin holder support 9 may be released from the housing 3 by pressing on tab 19. A similar projection 19 and notch 23 may also located on the back wall 15 of the housing 3 and the back side of the coin holder support 9.

Figure 2:
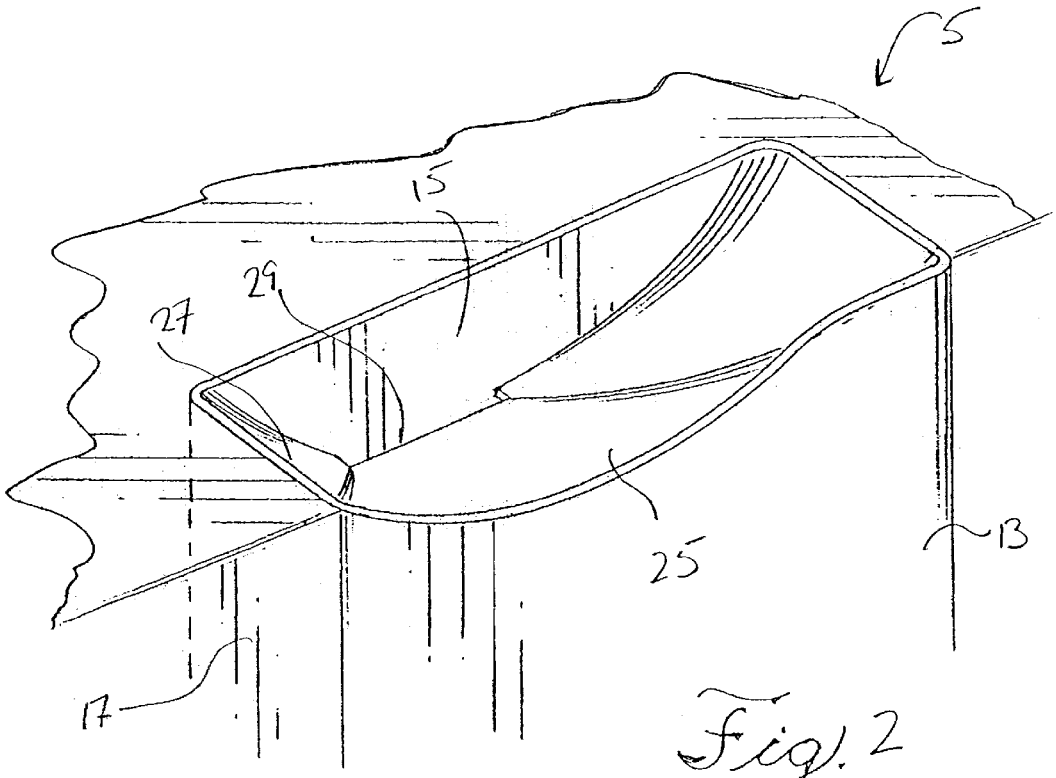
FIG. 2 is a perspective top view of one embodiment of a hopper for the coin sorting and dispensing apparatus of the present invention.

The hopper 5 is positioned in an upper portion of housing 3. As shown in the embodiment in FIG. 2, the hopper is defined by an inner sloping front wall 25, two inner sloping side walls 27, and the back wall 15. The inner front wall 25 and the inner side walls 27 slope downwardly toward a coin slot 29.

The housing 3 and hoper 5 may be made from plastic, foamed thermoplastic materials, metal, or any other suitable materials. Preferably, the housing and hopper are made from polypropylene, which assists in dampening the noise made by the coins as they pass through the coin sorting and dispensing apparatus.

Figure 3:
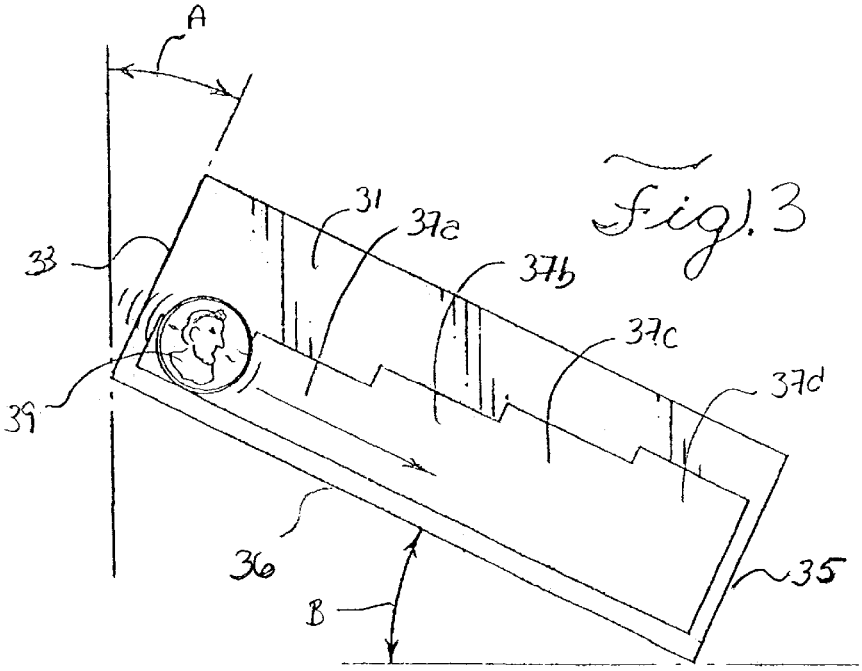
FIG. 3 is a front view of the coin sorter plate used in one embodiment of the coin sorting and dispensing apparatus of the present invention.

As shown in FIG. 1, the coin sorter plate 7 is positioned inside the housing 3 directly below the hopper 5 and sorts coins according to their diameter. As shown in FIGS. 1 and 3, the coin sorter plate is generally rectangular in shape and has a flat coin sliding surface 31. The coin sorter plate further has an upper end 33, a lower end 35, a bottom edge 36, and a plurality of "stair-step" slots 37*a–d*. The slots 37*a–d* are arranged in order of increasing size from the upper end of the plate 33 to the lower end of the plate 35 such that the smallest slot 37*a* is at the upper end of the plate 33 and the largest slot 37*d* is at the lower end of the plate 35. With the slots 37*a–d* in this arrangement, the coins having the smallest diameter will be sorted first while those with largest diameter will pass over the smaller slots and be sorted last. In particular, as shown in FIG. 3, a coin 39 will slide down the surface 31 of the sorter plate in the direction of the arrow, and will fall through the first slot encountered which is sufficiently large enough for the coin to fall through.

Those of ordinary skill in the art will appreciate that the size and number of slots formed in the plate will correspond directly to the number of coins with different diameters that need to be sorted. Thus, the sorter plate 7 may be adapted to sort any number of coins with different diameters from any country. The sorter plate shown in FIG. 3 is sized and configured to sort coins from the United States of America. The sorter plate 7 has four differently sized sorting slots with slot 37*a* corresponding to the dime, slot 37*b* corresponding to the penny, slot 37*c* corresponding to the nickel, and slot 37*d* corresponding to the quarter. Those skilled in the art will further appreciate that the sorter plate 7 may also include appropriately sized slots to sort a half dollar or a dollar coin.

In order to ensure that coins slide quickly and efficiently down the surface 31 of the sorter plate 7, the sorter plate is fixed within the housing 3 at both a longitudinal and transverse incline. As shown in FIG. 3, the transverse incline is represented by angle A and the longitudinal incline is represented by angle B. In a preferred embodiment, angle A is approximately 30° from vertical and angle B is approximately 20° from horizontal.

The sorter plate may be formed from plastic, glass, steel, aluminum, stainless steel, or any other suitable material having a sufficiently low coefficient of friction to allow coins to slide down the plate. If the sorter plate is formed from metal it may be advantageous to coat the sorter plate with a tetrafluoroethylene based resin, such as Teflon® sold by Du Pont, in order to ensure that the coins slide smoothly down the plate.

The length and width of the sorter plate 7 is slightly smaller than the length and width of the housing 3 such that the sorter plate fits within the housing 3. The sorter plate 7 may be affixed to the interior of the housing by ultrasonic welding, adhesive, rivets, screws, or any other suitable method. In one embodiment, the sorter plate 7 is formed from a polyvinylchloride based plastic and is affixed in the housing by ultrasonic welding.

Figure 7:
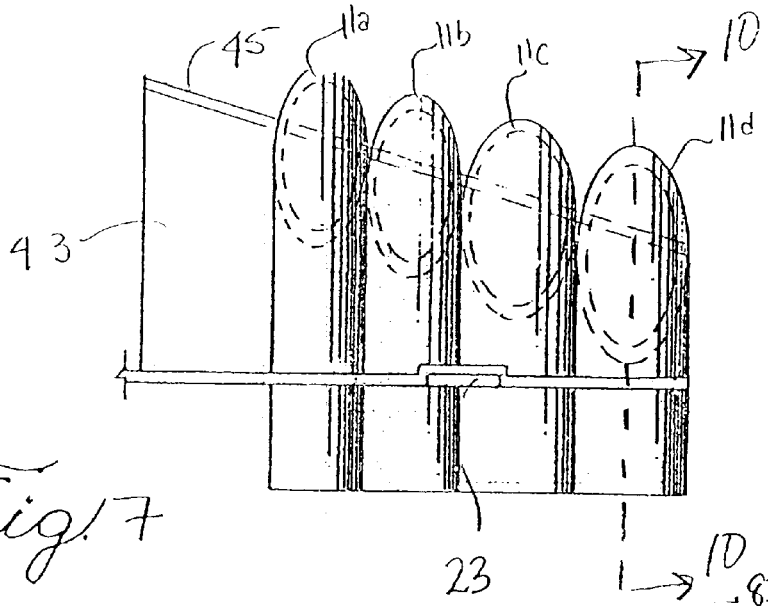
FIG. 7 is a rear view of the coin holder support of FIG. 4.

Referring now to FIGS. 1 and 7, the coin holder support 9 has a generally horizontal bottom shelf 41 and a generally vertical inclined back 43 with a top edge 45. The incline of the back 43 corresponds to the longitudinal incline of the sorter plate 7. Thus, when the coin support 9 is mounted in housing 3, the top edge 45 of the side wall 43 corresponds to the bottom edge 36 of the sorter plate 7. The bottom shelf 41 has a plurality of openings 46 through which coin holders 11*a–d* are inserted and fixed.

If desired, the coin holders 11*a–d* may be removably mounted in the support 9 as shown in FIG. 4. Removable coin holders provide several advantages, including but not limited to, easier cleaning of the coin sorter and removal of several sorted coins from a holder at one time. Like the housing 3 and the hopper 5, the coin holder 9 and the coin holders 11*a–d* may be plastic, foamed thermoplastic materials, metal, polypropylene or any other suitable materials.

As shown in FIG. 4, the generally circular openings 46 in the coin holder support 9 through which the coin holders 11*a–d* are inserted each have a pair of laterally spaced resilient jaws 49 extending horizontally outward from the openings. The distance C between the jaws 49 is smaller than the diameter of the coin holder that is to be inserted into the corresponding opening 46. The jaws 49, however, are sufficiently resilient to permit the coin holders 11*a–d* to be moved laterally in or out of the generally circular opening with a small amount of force, but are sufficiently rigid to retain the coin holders 11*a–d* in the openings during normal use of the coin sorting and dispensing apparatus.

Coin holders 11*a–d* are formed from holder side walls 57 and holder bottoms 59 and are generally cylindrically shaped. Upper ends 61 of the coin holders are positioned inside housing 3 just below the coin sorter plate and are open to receive coins from the sorter plate. The upper ends 61 of the coin holders 11*a–d* may be cut at an angle, i.e., have chamfered edges, which directly correspond to the longitudinal angle of the sorter plate 7. The lower ends 63 of the coin holders extend through the bottom shelf 41 of the coin holder support 9 and are easily accessible to the driver.

Each coin holder 11 has a diameter, which is sufficiently large to accommodate the diameter of one of the coins to be sorted and stored therein. However, the diameter of each holder is preferably small enough so that coins stored therein will be stacked one on top of another in a vertical column.

A particular sized coin holder 11 generally is provided for each size coin to be sorted. As shown in FIGS. 1, 4, and 7, the coin holder 11*a* has an appropriate diameter to receive and store dimes, the coin holder 11*b* has an appropriate diameter to receive and store pennies, the coin holder 11*c* has an appropriate diameter to receive and store nickels, and coin holder 11*d* has an appropriate diameter to receive and store quarters.

Coins that have been sorted into coin holders 11*a–d* may be readily dispensed from the lower ends 63 of the holders. As shown in FIGS. 5–6 and 8–10, coins are generally removed through openings 71 formed in the holder side walls 57 of the lower ends 63 of the holders 11*a–d*. The openings 71 must be sufficiently large to remove coins from the holders, but must not be so large as to allow coins to fall out of the coin holder.

With particular reference to FIG. 5, a U-shaped recess 73, shown in phantom, is formed in the bottom 59 of the coin holder 11*d*. The U-shaped recess 73 exposes a portion of the coin 39 through the bottom 59 of the coin holder. As shown in FIG. 6, the coin 39 may be removed from coin holder 11*d* by placing an index finger 77 on the exposed portion of the coin 39. The coin may then be drawn away from the coin holder in the direction of the arrow to remove the coin 39 from the holder. Once the coin is partially removed from the holder 11*d*, the coin may be grasped between the index finger and the thumb and completely removed from the holder.

Figure 9:
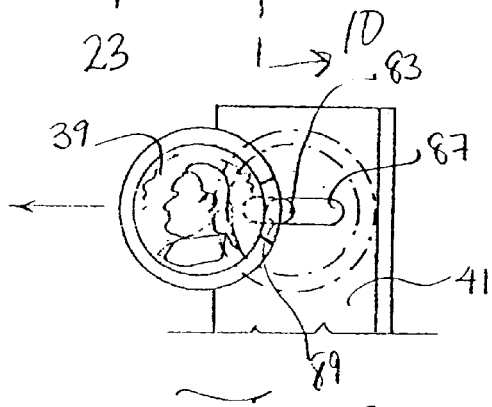
FIG. 9 is a top view of the coin holder 11*d* with the coin dispensing mechanism shown in FIG. 1.
Figure 8:
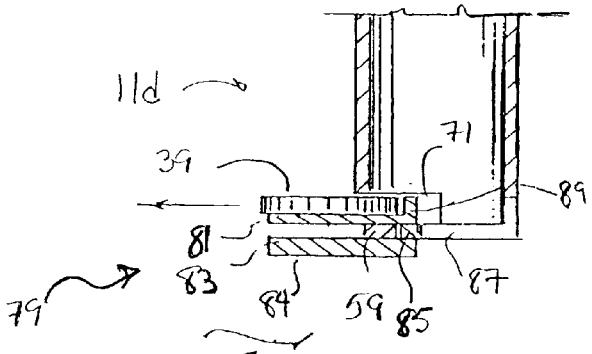
FIG. 8 is a partial cross-sectional view of the coin holder 11*d* shown in FIG. 1 taken along line 11—11 illustrating another embodiment of a coin dispensing mechanism.

Alternatively, coins may be removed from the coin holders 11*a–d* by a manual or an "automatic" coin dispensing mechanism. For purposes of simplicity, the manual and automatic coin slides will be discussed with respect to a single coin holder 11*d*, but the description is applicable to all of the coin holders 11*a–d*. As shown in FIGS. 8 and 9, the coin holder 11*d* has an opening 71 in the holder side wall 57 and a manual coin dispensing mechanism 79 in the lower end 63 of the coin holder. The manual coin dispensing mechanism 79 has a generally flat, circular upper coin plate 81 positioned above the bottom 59 of the coin holder and a generally flat circular lower slide plate 83 positioned below the bottom 59 of the coin holder. Lower slide plate 83 further has a bottom surface 84. A slide post 85 connects the upper coin plate 83 and the lower plate through a generally oval shaped slot 87 in the bottom 59 of the coin holder 11*d*. The slide post moves back and forth in slot 87 permitting the upper coin plate 81 to be moved in and out of the lower end 59 of the coin holder 11*d*. A generally arc shaped flange 89 extends vertically from the back of the upper coin plate 81 and assists in keeping the coin 39 on the upper coin plate 81.

In order to dispense a coin using the manual coin dispensing mechanism 79, the index finger is placed on the bottom surface 84 of the lower slide plate 83, and the lower slide plate 83 is drawn away from the coin holder 11*d* in the direction of the arrow. The upper slide plate 81, which is connected to the lower slide plate 83 by post 85, is simultaneously drawn out of the coin holder 11*d* and dispenses the coin 39. The coin 39 is then removed from the upper slide plate 81, before the upper slide plate 81 is pushed back into the coin holder 11*d*. Arc shaped flange 89 prevents any coins, which may remain in the coin holder from falling down behind the upper coin plate 81 when the plate is drawn out of the coin holder 11*d*.

Figure 10:
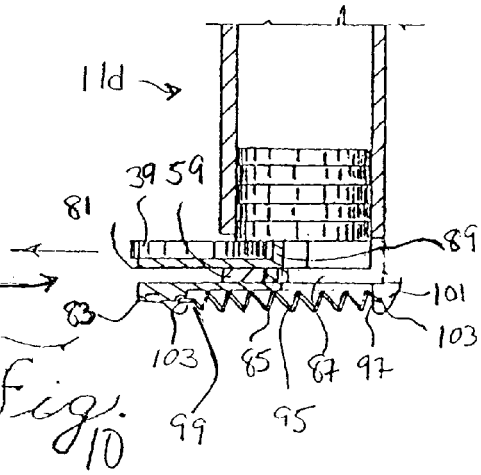
FIG. 10 is a partial cross-sectional view of the coin holder 11*d* of FIG. 7 taken along line 10—10 illustrating another embodiment of a coin dispensing mechanism.

Alternatively, as shown in FIG. 10, the coin dispensing mechanism may be "automatic." Similar to the manual coin dispensing mechanism 79, the automatic coin dispensing mechanism 93 has an upper slide plate 81 with a flange 89, a lower slide plate 83, and a slide post 85 connecting the upper slide plate 81 and the lower slide plate 85 through an oval shaped slot 87 in the bottom 59 of the coin holder 11*d*. In addition, the automatic dispensing mechanism has a resilient member 95. As shown in FIG. 10, the resilient member 95 is a metal or plastic spring with a first end 97 and a second end 99. The resilient member may also be an elastic band or the like. The first end 97 of the resilient member 95 is affixed to a projection 101 extending downwardly from the rear of the bottom 59 of the coin holder 11*d*. The second end 99 of the resilient member 95 is affixed to the lower slide plate 83. As shown in FIG. 10, the first end 97 and the second end 99 of the resilient member 95 are threaded through openings 103 in the projection 101 and the lower slide plate 83. However, it will be appreciated by those skilled in the art that the resilient member may be affixed to the projection 101 and the lower slide plate 83 by any suitable method. Alternatively, one end of the resilient member may be attached to the upper slide plate 81 and the other end of the resilient member may be attached to the side wall 57 of the coin holder 11*d*.

In order to dispense a coin using the automatic coin dispensing mechanism 93, the index finger is placed on the bottom surface 84 of the lower slide plate 83, and the lower slide plate 83 is drawn away from the coin holder 11*d* in the direction of the arrow placing the resilient member 95 under tension. The upper slide plate 81, which is connected to the lower slide plate 83 by post 85, is simultaneously drawn out of the coin holder 11*d* and dispenses the coin 39. The coin is then removed from the upper slide plate 81 before releasing the lower slide plate 83. Once the lower slide plate 83 is released, the upper coin plate will automatically return to the interior of the coin holder 11*d* as a result of the tension in the resilient member. Arc shaped flange 89 prevents any coins, which may remain in the coin holder from falling down behind the upper coin plate 81 when the plate is drawn out of the coin holder 11*d*.

Figure 11:
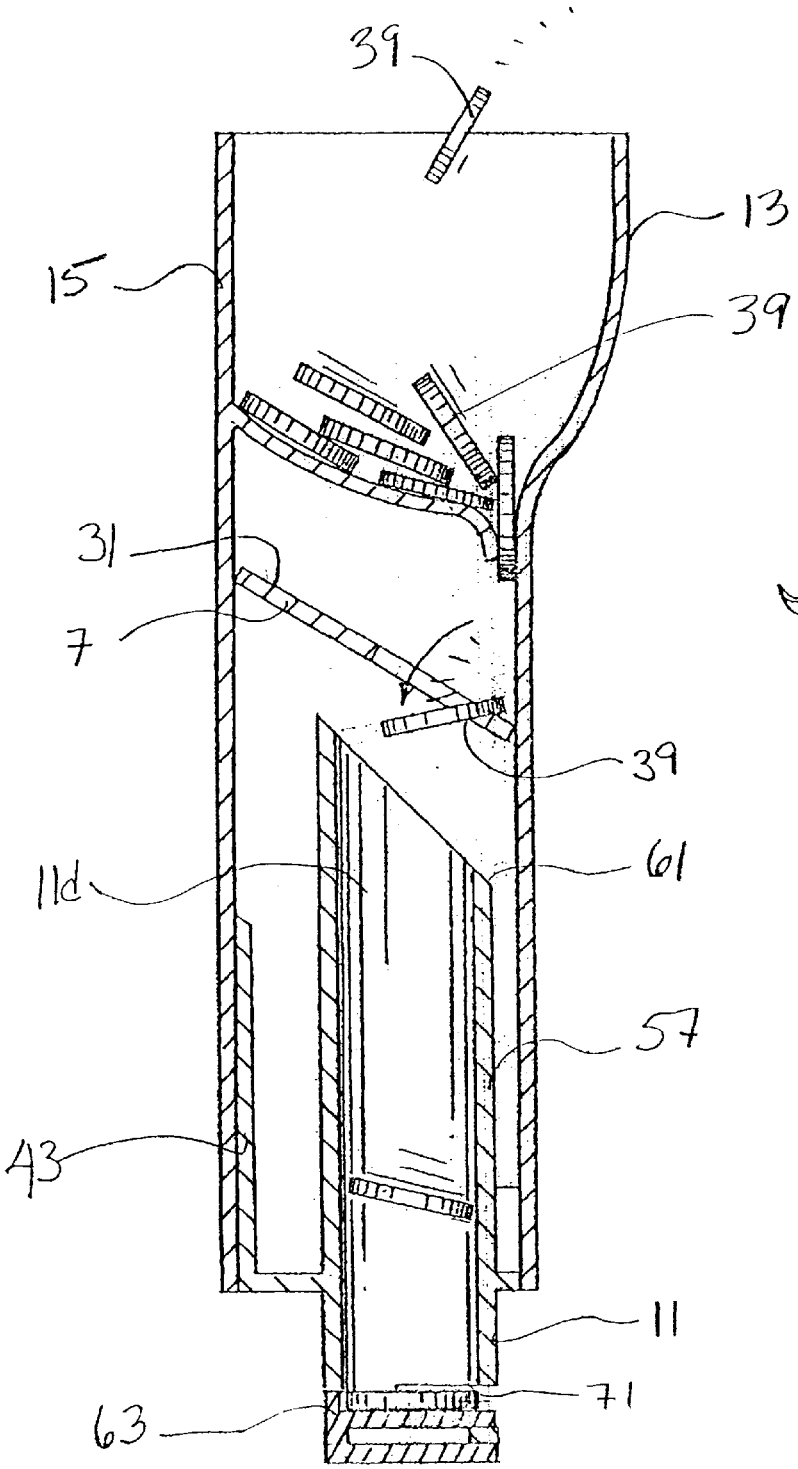
FIG. 11 is a cross-sectional view of the coin sorting and dispensing apparatus shown in FIG. 1 taken along line 11—11.

In operation as illustrated in FIG. 11, coins 39 are placed in the hopper 5, slide down into the hopper, and slide through the coin slot 29 one at a time. After passing through the coin slot 29, the coins fall one at time onto the coin sorter plate 37. As a coin slides down the coin sorter plate, it falls off the plate when the opening is sufficiently large enough. Acceleration and deceleration of the motor vehicle as well as driving over bumps in the road assists in moving the coins 39 down into the hopper, through the coin slot, onto the sorter plate, and through the sorter slots. As a coin falls off of the sorter plate, the coin rotates 180 degrees away from the sorter plate as shown by the arrow in FIG. 11. The coin then drops into a coin holder positioned below the sorter plate and settles to the lower end 63 of the holder 11*d*. The coin 39 may then be removed through the opening 71 at the lower end of the coin holder 11*d*.

While the invention with its several embodiments has been described in detail, it should be understood that various modifications may be made to the present invention without departing from the scope of the invention. The following claims, including all equivalents define the scope of the invention.

What is claimed is:

1. A coin sorting and dispensing apparatus for a motor vehicle comprising:

a front wall, a back wall, and two end walls forming a housing, said housing having an upper portion and a lower portion;

a coin hopper positioned in the upper portion of the housing, said hopper having an opening sized to allow the passage of coins therethrough;

a sorter plate for sorting coins of different denominations disposed at a longitudinal downward incline below the hopper, said sorter plate comprising at least one slot; and a coin holder support affixed in the lower portion of the housing below the sorter plate including at least one coin holder, said coin holder having a side walls with an upper end and a lower end and a bottom forming a chamber, said lower end of said coin holder having a coin dispensing slot;

wherein said coin sorting and dispensing apparatus is mounted in the interior of the motor vehicle.

2. The coin sorting and dispensing apparatus of claim 1, wherein the housing is removably mounted to the interior of the motor vehicle.

3. The coin sorting and dispensing apparatus of claim 1, wherein the sorting and dispensing apparatus is integrally mounted in a dashboard, a door panel, an interior side panel, or a console of the motor vehicle.

4. The coin sorting and dispending apparatus of claim 1, wherein the sorter plate is further disposed at a transverse incline.

5. The coin sorting and dispensing apparatus of claim 4, wherein the longitudinal downward incline is about 20 degrees from horizontal and the transverse incline is about 30 degrees from vertical.

6. The coin sorting and dispensing apparatus of claim 1, wherein the sorter plate comprises a plurality of slots increasing in size along the downward incline.

7. The coin sorting and dispensing apparatus of claim 1, wherein the sorter plate slots are stair-step shaped.

8. The coin sorting and dispensing apparatus of claim 1, wherein said sorter plate is coated with a fluorine based resin.

9. The coin sorting and dispensing apparatus of claim 1 wherein the coin holder support is removably fixed in the lower portion of the housing.

10. The coin sorting and dispensing apparatus of claim 1 further comprising a plurality of coin holders.

11. The coin sorting and dispensing apparatus of claim 10, wherein said coin holders are removably mounted in the coin holder support.

12. The coin sorting and dispensing apparatus of claim 10, wherein said coin holders are sized to receive and store coins of different denominations.

13. The coin sorting and dispensing apparatus of claim 10, wherein said upper ends of said coin holders have chamfered edges.

14. The coin sorting and dispensing apparatus of claim 1, wherein said bottom of said coin holder has a U-shaped opening which exposes a portion of a face of said coin stored therein.

15. The coin sorting and dispensing apparatus of claim 1, wherein said coin holder further comprises a coin dispensing mechanism, said dispensing mechanism comprising:

an upper coin plate positioned in said coin holder above said bottom;

a lower coin plate positioned below said bottom; and a post extending through an aperture in said bottom connecting said upper coin plate and said lower coin plate;

wherein when said lower coin plate is drawn away from said coin holder, the upper plate exits said coin holder and dispenses a coin.

16. The coin sorting and dispensing apparatus of claim 15, further comprising a resilient member having a first end and a second end, said first end affixed to said bottom of said coin holder and second end affixed to said lower coin plate;

wherein when said lower coin plate is drawn away from said coin holder, the upper plate exits said coin holder and dispenses a coin, and when said lower plate is released, said upper plate automatically retracts into said coin holder.

17. The coin sorting and dispensing apparatus of claim 15, further comprising a resilient member having a first end and a second end, said first end affixed to said upper slide plate and said second end affixed to said side wall;

wherein when said lower coin plate is drawn away from said coin holder, the upper plate exits said coin holder and dispenses a coin, and when said lower plate is released, said upper plate automatically retracts into said coin holder.

18. A method for sorting, storing, and dispensing coins in a motor vehicle comprising:

placing coins having different denominations in a hopper positioned in a housing affixed to an interior portion of the motor vehicle;

moving said motor vehicle;

passing said coins through the hopper and onto a longitudinally downwardly inclined sorter plate positioned below said hopper, said sorter plate comprising at least one slots increasing in size along the downward incline;

sliding said coins down the sorter plate;

sorting said coins according to denomination into coin holders affixed to a coin holder support positioned below said sorter plate slots;

storing said sorted coins in said coin holders; and dispensing said coins from said coin holders when needed.

19. The method of claim 18, wherein said sorter plate slots are stair-step shaped.

20. The method of claim 18, wherein the housing is removably affixed to the interior portion of the vehicle.

21. The method of claim 18, wherein the coin holders are removably affixed to the coin holder support.

22. The method of claim 18, wherein the sorter plate is further disposed at a transverse incline.

* * * * *